US007998402B2

(12) United States Patent
Telioui et al.

(10) Patent No.: US 7,998,402 B2
(45) Date of Patent: Aug. 16, 2011

(54) HIGH STRENGTH WELDABLE AL-MG ALLOY

(75) Inventors: Nadia Telioui, Rotterdam (NL); Steven Dirk Meijers, Alkmaar (NL); Andrew Norman, Beverwijk (NL); Achim Buerger, Hoehr-Grenzhausen (DE); Sabine Maria Spangel, Koblenz (DE)

(73) Assignee: Aleris Aluminum Koblenz, GmbH, Koblenz (DE)

( * ) Notice: Subject to any disclaimer, the term of this patent is extended or adjusted under 35 U.S.C. 154(b) by 0 days.

(21) Appl. No.: 11/464,387

(22) Filed: Aug. 14, 2006

(65) Prior Publication Data

US 2009/0226343 A1 Sep. 10, 2009

(30) Foreign Application Priority Data

Aug. 16, 2005 (EP) ..... 05076898

(51) Int. Cl.
*C22C 21/06* (2006.01)
*C22C 21/00* (2006.01)

(52) U.S. Cl. ..... 420/545; 420/543; 420/547; 420/551; 420/553; 148/440

(58) Field of Classification Search ..... 148/437, 148/440; 420/528, 542, 543, 553, 545, 547, 420/551
See application file for complete search history.

(56) References Cited

U.S. PATENT DOCUMENTS

| | | | | |
|---|---|---|---|---|
| 5,359,188 | A * | 10/1994 | Kubo et al. | 250/214 VT |
| 6,238,495 | B1 | 5/2001 | Haszler et al. | |
| 6,258,318 | B1 | 7/2001 | Lenczowski et al. | |
| 6,337,147 | B1 | 1/2002 | Haszler et al. | |
| 6,416,884 | B1 | 7/2002 | Haszler et al. | |
| 6,551,424 | B1 * | 4/2003 | Haszler et al. | 148/552 |
| 6,695,935 | B1 | 2/2004 | Haszler et al. | |
| 6,773,664 | B2 * | 8/2004 | Spanjers et al. | 420/541 |
| 2001/0050118 | A1 | 12/2001 | Raynaud et al. | |
| 2002/0006352 | A1 | 1/2002 | Spanjers et al. | |
| 2003/0145912 | A1 * | 8/2003 | Haszler et al. | 148/417 |
| 2005/0037188 | A1 * | 2/2005 | Ehrstrom et al. | 428/299.4 |

FOREIGN PATENT DOCUMENTS

| | | | |
|---|---|---|---|
| FR | 2 731 019 | A1 | 8/1996 |
| JP | 10237577 | A * | 9/1998 |
| WO | 9917903 | A1 | 4/1999 |
| WO | 9942627 | | 8/1999 |
| WO | 9942627 | A1 | 8/1999 |
| WO | 0054967 | A1 | 9/2000 |
| WO | 0066800 | A1 | 11/2000 |

OTHER PUBLICATIONS

Caron et al., ACM Handbook-Effects of Composition, Processing, and Structure on Properties of Nonferrous Alloys-Aluminum and Aluminum Alloys, 1997, ASM International, vol. 20, p. 3-5.*

Prof. D. Altenpohl, "Aluminum Viewed from Within", An Introduction into the Metallurgy of Aluminum Fabrication, 1st Edition, Aluminium-Verlag (1992).

* cited by examiner

*Primary Examiner* — Roy King
*Assistant Examiner* — Caitlin Fogarty
(74) *Attorney, Agent, or Firm* — Novak Druce + Quigg, LLP

(57) ABSTRACT

An aluminium alloy product having high strength, excellent corrosion resistance and weldability, having the following composition in wt. %: Mg 3.5 to 6.0, Mn 0.4 to 1.2, Fe<0.5, Si<0.5, Cu<0.15, Zr<0.5, Cr<0.3, Ti 0.03 to 0.2, Sc<0.5, Zn<1.7, Li<0.5, Ag<0.4, optionally one or more of the following dispersoid forming elements selected from the group consisting of erbium, yttrium, hafnium, vanadium, each <0.5 wt. %, and impurities or incidental elements each <0.05, total <0.15, and the balance being aluminium.

30 Claims, No Drawings

HIGH STRENGTH WELDABLE AL-MG ALLOY

CROSS REFERENCE TO RELATED APPLICATION

This claims the benefit of European patent application no. 05076898.5 filed 16 Aug. 2005, incorporated herein by reference in its entirety.

FIELD OF THE INVENTION

The invention relates to an aluminium alloy product, in particular an Al—Mg type (also known as 5xxx series aluminium alloy as designated by the Aluminium Association). More in particular, the present invention relates to a high strength, low density aluminium alloy with excellent corrosion resistance and weldability. Products made from this new alloy are very suitable for applications in the transport industry such as application in aerospace products, vessels, road and rail vehicles, shipbuilding and in the construction industry.

The alloy can be processed to various product forms, e.g. sheet, thin plate or extruded, forged or age formed products. The alloy can be uncoated or coated or plated with another aluminium alloy in order to improve even further the properties, e.g. corrosion resistance.

BACKGROUND OF THE INVENTION

Different types of aluminium alloys have been used in the past for manufacturing a variety of products for application in the construction and transport industry, more in particular also in the aerospace and maritime industry. Designers and manufacturers in these industries are constantly trying to improve product performance, product lifetime and fuel efficiency, and are also constantly trying to reduce manufacturing, operating and service costs.

One way of obtaining the goals of these manufactures and designers is by improving the relevant material properties of aluminium alloys, so that a product to be manufactured from that alloy can be designed more effectively, can be manufactured more efficiently and will have a better overall performance.

In many applications referred to above, alloys are required which have high strength, low density, excellent corrosion resistance, excellent weldability and excellent properties after welding.

The present invention relates to an alloy of the AA 5xxx type combining improved properties in the fields of strength, damage tolerance, corrosion resistance and weldability.

As will be appreciated, herein below, except as otherwise indicated, alloy designations and temper designations refer to the Aluminium Association designations in Aluminium Standards and Data and Registration Records as published by the Aluminium Association in 2005.

SUMMARY OF THE INVENTION

An object of the present invention is to provide an aluminium-magnesium alloy product of the AA5xxx series of alloys, as designated by the Aluminium Association, having high strength, low density and excellent corrosion properties.

A further object of the present invention is to provide an aluminium-magnesium alloy product having good weldability properties Another object of the present invention is to provide an aluminium-magnesium alloy product showing high thermal stability and suitable for use in the manufacturing of products therefrom formed by plastic forming processes such as creep forming, roll forming and stretch forming.

These and other objects and further advantages are met or exceeded by the present invention concerning an aluminium alloy comprising and in a preferred mode consisting essentially of in weight %:

Mg 3.5 to 6.0
Mn 0.4 to 1.2
Fe<0.5
Si<0.5
Cu<0.15
Zr<0.5
Cr<0.3
Ti 0.03 to 0.2
Sc<0.5
Zn<1.7
Li<0.5
Ag<0.4, optionally one or more of the following dispersoid forming elements selected from the group consisting of erbium, yttrium, hafnium, vanadium, each <0.5, and impurities or incidental elements each <0.05, total <0.15, and the balance being aluminium.

DETAILED DESCRIPTION OF THE PREFERRED EMBODIMENTS

An embodiment of the present invention includes an aluminium alloy comprising and in a preferred mode consisting essentially of in weight %:

Mg 3.5 to 6.0
Mn 0.4 to 1.2
Fe<0.5
Si<0.5
Cu<0.15
Zr<0.5
Cr<0.3
Ti 0.03 to 0.2
Sc<0.5
Zn<1.7
Li<0.5
Ag<0.4, optionally one or more of the following dispersoid forming elements selected from the group consisting of erbium, yttrium, hafnium, vanadium, each <0.5, and impurities or incidental elements each <0.05, total <0.15, and the balance being aluminium.

According to the invention, Mg is added to provide the basic strength of the alloy. When the Mg content is in the range 3.5 to 6 wt. %, the alloy can achieve its strength through solid solution hardening or work hardening. A suitable range for Mg is 3.6 to 5.6 wt. %, a preferred range is 3.6 to 4.4 wt. %, and a more preferred range is 3.8 to 4.3 wt. %. In an alternative preferred range the Mg content is in the range of 5.0 to 5.6 wt. %.

The addition of Mn is important in the alloy according to the invention as a dispersoid forming element and its content lies in the range 0.4 to 1.2 wt. %. A suitable range is 0.6 to 1.0 wt. %, and a more preferred range is 0.65 to 0.9 wt.

To prevent adverse effects of the alloying elements Cr and Ti, Cr preferably is in the range of 0.03 to 0.15 wt. %, more preferably 0.03 to 0.12 wt. % and further more preferably 0.05 to 0.1 wt. %, and Ti preferably is in the range of 0.03 to 0.15 wt. %, more preferably 0.03 to 0.12 wt. % and further more preferably 0.05 to 0.1 wt. %.

A further improvement of the aluminium alloy according to the invention is obtained in an embodiment wherein both Cr and Ti are present in the aluminium alloy product preferably in equal or about equal quantities.

A suitable maximum for the Zr level is a maximum of 0.5 wt. %, preferably a maximum of 0.2 wt. %. However, a more preferred range is 0.05 to 0.25 wt. %, a further preferred range is 0.08 to 0.16 wt. %.

A further improvement in properties, particularly weldability, can be achieved with an embodiment of the invention in which Sc is added as an alloying element in the range of 0 to 0.3 wt. %, preferably in the range of 0.1 to 0.3 wt. %.

In another embodiment the effect of adding Sc can be further enhanced by the addition of Zr and/or Ti. Both Ti and Zr can combine with Sc to form a dispersoid which has a lower diffusivity than the Sc dispersoid alone and a reduced lattice mismatch between the dispersoid and aluminium matrix, which results in a reduced coarsening rate. An additional advantage to adding Zr and/or Ti is that less Sc is needed to obtain the same recrystallisation inhibiting effect.

It is believed that improved properties with the alloy product of this invention, particularly high strength and good corrosion resistance, are obtained by a combined addition of at least two of Cr, Ti and Zr to an Al—Mg alloy which already contains an amount of Mn.

Preferably Cr is combined with Zr to a total amount of 0.06 to 0.25 wt. %.

In another preferred embodiment of the alloy according to the invention Cr is combined with Ti to a total amount in the range of 0.06 to 0.22 wt. %.

In still another preferred embodiment of the alloy according to this invention Zr is combined with Ti in the alloy to a total amount in the range of 0.06 to 0.25 wt. %.

In yet another preferred embodiment of the alloy according to the invention, Cr is combined with Ti and Zr to a total amount of these elements in the range of 0.09 to 0.36 wt. %.

In another embodiment Zn may be added to the alloy in the range 0 to 1.7 wt. %. A suitable range for Zn is 0 to 0.9 wt. %, and preferably 0 to 0.65 wt. %, more preferably 0.2 to 0.65 wt. % and further more preferably 0.35 to 0.6 wt. %. Alternatively, when Zn is not intentionally added to the alloy in an active amount, the alloy can be substantially free of Zn. However trace amounts and/or impurities may have found their way into the aluminium alloy product.

Iron can be present in a range of up to 0.5 wt. % and preferably is kept to a maximum of 0.25 wt. %. A typical preferred iron level would be in the range of up to 0.14 wt. %.

Silicon can be present in a range of up to 0.5 wt. % and preferably is kept to a maximum of 0.25 wt. %. A typical preferred Si level would be in the range of up to 0.12 wt. %.

Similarly, while copper is not an intentionally added additive, it is a mildly soluble element with respect to the present invention. As such, the aluminium alloy product according to the invention may contain up to 0.15 wt. % Cu., and a preferred maximum of 0.05 wt. %.

Optional elements may be present in the aluminium alloy product of the invention. Vanadium may be present in the range up to 0.5 wt. %, preferably up to 0.2 wt. %, lithium in the range up to 0.5 wt. %, hafnium in the range up to 0.5 wt. %, yttrium in the range up to 0.5 wt. %, erbium in the range up to 0.5 wt. %, and silver in the range up to 0.4 wt. %.

In a preferred embodiment the aluminium alloy product according to the invention essentially consists of, in wt. %:

Mg 3.8-4.3
Mn 0.65-1.0
Zr<0.5, preferably 0.05 to 0.25
Cr<0.3, preferably 0.1 to 0.3
Ti 0.03 to 0.2, preferably 0.05 to 0.1
Sc<0.5, preferably 0.1 to 0.3
Fe<0.14
Si<0.12 balance aluminium, and impurities or incidental elements, each <0.05, total <0.15. Preferably the aluminium alloy product further has Zn in the range of 0.2 to 0.65 wt. %.

In another preferred embodiment the aluminium alloy product according to the invention essentially consists of, in wt. %:

Mg 5.0-5.6
Mn 0.65-1.0
Zr<0.5, preferably 0.05 to 0.25
Cr<0.3, preferably 0.1 to 0.3
Ti 0.03 to 0.2, preferably 0.05 to 0.1
Sc<0.5, preferably 0.1 to 0.3
Fe<0.14
Si<0.12 balance aluminium, and impurities or incidental elements, each <0.05, total <0.15. Preferably the aluminium alloy product further has Zn in the range of 0.2 to 0.65 wt. %.

The processing conditions required to deliver the desired properties depend on the choice of alloying conditions. For the alloying addition of Mn, the preferred pre-heat temperature prior to rolling is in the range 410° C. to 560° C., and more preferably in the range 490° C. to 530° C. However at this optimum temperature range, the elements Cr, Ti, Zr and Sc perform less effectively, with Cr performing the best of these. To produce the optimum performance of Cr, Ti, Zr and especially in combination with Sc, a lower temperature preheat treatment is preferred prior to hot rolling, preferably in the range 280° C. to 500° C., more preferably in the range 400° C. to 480° C.

The aluminium alloy product according to the invention exhibits an excellent balance of properties for being processed into a product in the form of a sheet, plate, forging, extrusion, welded product or a product obtained by plastic deformation. Processes for plastic deformation include, but are not limited to, such processes as age forming, stretch forming and roll forming.

The combined high strength, low density, high weldability and excellent corrosion resistance of the aluminium alloy product according to the invention, make this in particular suitable as product in the form of a sheet, plate, forging, extrusion, welded product or product obtained by plastic deformation as part of an aircraft, a vessel or a rail or road vehicle.

In a further embodiment, in particular where the aluminium alloy product has been extruded, preferably the alloy product has been extruded into profiles having at their thickest cross section point a thickness in the range up to 150 mm.

In extruded form the alloy product can also replace thick plate material, which is conventionally machined via machining or milling techniques into a shaped structural component. In this embodiment the extruded product has preferably at its thickest cross section point a thickness in the range of 15 to 150 mm.

The excellent property balance of the aluminium alloy product is being obtained over a wide range of thicknesses. In the plate thickness range of 0.6 to 1.5 mm the aluminium alloy product is of particular interest as automotive body sheet. In the thickness range of up to 12.5 mm the properties will be excellent for fuselage sheet. The thin plate thickness range can be used also for stringers or to form an integral wing panel and stringers for use in an aircraft wing structure. In the thickness range of 15 to 80 mm the properties will be excellent for ship building and general construction applications such as pressure vessels.

The aluminium alloy product according to the invention can also be used as tooling plate or mould plate, e.g. for moulds for manufacturing formed plastic products for example via die-casting or injection moulding.

The aluminium alloy product of the invention is particularly suitable for applications where damage tolerance is required, such as damage tolerant aluminium products for aerospace applications, more in particular for stringers, pressure bulkheads, fuselage sheet, lower wing panels, thick plate for machined parts or forgings or thin plate for stringers.

The combined high strength, low density, excellent corrosion resistance and thermal stability at high temperatures make the aluminium alloy product according to the invention in particular suitable to be processed by creep forming (also known as age forming or creep age forming) into a fuselage panel or other pre-formable component for an aircraft. Also, other processes of plastic forming such as roll forming or stretch forming can be used.

Dependent on the requirements of the intended application the alloy product may be annealed in the temperature range 100-500° C. to produce a product which includes, but is not limited to, a soft temper, a work hardened temper, or a temperature range required for creep forming.

The aluminium alloy product according to the invention is very suitable to be joined to a desired product by all conventional joining techniques including, but not limited to, fusion welding, friction stir welding, riveting and adhesive bonding.

EXAMPLES

The invention will now be illustrated with reference to the following examples.

Example 1

On a laboratory scale five alloys were cast to prove the principle of the current invention with respect to mechanical properties. In Table 1-1 the compositions in wt. % of alloys A to E are listed. The alloys were, on a laboratory scale, cast into ingots which were preheated at a temperature between 425° C. and 450° C. and kept there for 1 hour. The ingots were hot rolled from 80 mm to 8 mm and subsequently cold rolled with an interannealing step and a final cold reduction of 40% to a final thickness of 2 mm. The final plate was stretched 1.5% and annealed at a temperature of 325° C. for 2 hours.

TABLE 1-1

| Alloy | Mg | Mn | Zr | Sc | Cr | Ti |
|---|---|---|---|---|---|---|
| A | 4.0 | 0.9 | 0.10 | 0.15 | <0.002 | <0.002 |
| B* | 4.0 | 0.9 | 0.10 | 0.15 | <0.002 | 0.10 |
| C* | 4.0 | 0.9 | 0.10 | 0.15 | 0.10 | 0.10 |
| D* | 3.87 | 0.9 | 0.11 | 0.15 | 0.10 | 0.12 |
| E | 4.5 | 0.1 | 0.10 | 0.26 | <0.002 | <0.002 |

*according to the invention

Note:

All alloys contained 0.06 wt. % Fe and 0.04 wt. % Si, balance aluminium and impurities.

The available mechanical properties and physical properties of alloys A-E are listed in Table 1-2 and compared with typical values for AA2024-T3 and AA6013-T6. Alloy B, C and D are part of the present invention. Alloy A and alloy E are used as references.

TABLE 1-2

Mechanical properties and physical properties

| Alloy | Rp(TYS) MPa | Rm(UTS) MPa | Elongation at fracture A | Density gr/cm$^3$ |
|---|---|---|---|---|
| AA2024 T3 | 380 | 485 | 14 | 2.796 |
| AA6013 T6 | 365 | 393 | 11 | 2.768 |
| A | 346 | 420 | 10 | — |
| B* | 376 | 426 | 9.4 | — |
| C* | 393 | 439 | 7.6 | 2.655 |
| D* | 380 | 430 | 9 | — |
| E | 310 | 385 | 12 | 2.645 |

*according to the invention, all samples were taken in the L direction

"—" means not determined

Note:

The mechanical properties were established in accordance with ASTM EM8.

Note:

Rp, TYS stands for (tensile) yield strength; Rm, UTS stands for ultimate tensile strength; A stands for elongation at fracture The present invention comprises Mn as one of the required alloying elements to achieve competitive strength properties. The reference alloy A with 0.9 wt. % Mn shows an improvement of about 12% in yield strength (TYS) over reference alloy E which contains only 0.1 wt. % Mn. Further improvement in yield strength can be achieved with the alloy of the present invention. Alloy B contains a deliberate addition of 0.10 wt. % Ti and alloy B shows an improvement of about 9% in yield strength compared to reference alloy A and 21% improvement in yield strength over alloy E. An optimal improvement in yield strength can be achieved by the combined addition of Cr and Ti as illustrated by alloy C and D. Combining the Cr and Ti as described in the present invention (alloy C and D) gives an improvement of about 14% in yield strength over reference alloy A and 27% improvement over reference alloy E. Alloy C and D of the present invention not only show superior yield strength properties but also have a lower density over the established AA2024 and AA6013 alloys.

The alloys A, C and E were also subjected to a corrosion test to prove the principles of the present invention with regard to corrosion resistance.

The alloy composition, in wt. %, is given in Table 1-3.

TABLE 1-3

| Alloy | Mg | Mn | Zr | Sc | Cr | Ti |
|---|---|---|---|---|---|---|
| A | 4.0 | 0.9 | 0.10 | 0.15 | <0.002 | <0.002 |
| C* | 4.0 | 0.9 | 0.10 | 0.15 | 0.10 | 0.10 |
| E | 4.5 | 0.1 | 0.1 | 0.26 | <0.002 | <0.002 |

*according to the invention

Note:

The alloys contained 0.06 wt. % Fe and 0.04 wt. % Si, balance aluminium and impurities.

The chemical composition of the alloys A and E fall outside the present invention; the chemical composition of alloy C falls within the chemistry of an alloy of the invention.

All three alloys were processed as described above except that the alloys were cold rolled to a final thickness of 3 mm.

Plates made from the processed alloy were welded and the corrosion was measured using the standard ASTM G66 test also known as the ASSET test.

Laser beam welding was used for the welding trials. The welding power was 4.5 kW, welding speed 2 m/min using a ER 5556 filler wire.

The results of the corrosion test are shown in Table 1-4.

The corrosion performance of the base metal as well as in the welded condition was tested.

TABLE 1-4

| Corrosion properties | | | | | | | | | |
|---|---|---|---|---|---|---|---|---|---|
| | Non sensitized | | | Sensitized 100° C./7days | | | Sensitized 120° C./7 days | | |
| Alloy | Weld | HAZ | Base metal | Weld | HAZ | Base metal | Weld | HAZ | Base metal |
| A | N | N | N | N | N | N | N | E-D | PB-A |
| C* | N | N | N | N | N | N | N | N | PB-A |
| E | N | PB-B | PB-B | N | PB-B | PB-C | N | PB-B | PB-C |

*according to the invention

HAZ stands for heat affected zone.

The ratings N, PB-A, PB-B and PB-C respectively represent no pitting, slight pitting, moderate pitting and severe pitting. Rating E-D represents very severe exfoliation.

The invention discloses a low-density alloy with good mechanical properties in combination with good corrosion resistance. Thus, the inventive composition makes a good candidate for the transportation market and especially for aerospace application.

As Table 1-4 shows, alloy C which represents an alloy of the invention has improved corrosion properties over the alloys A and E, falling outside the invention, in the base metal, HAZ and the weld.

Example 2

Aluminium alloys of the AA 5xxx series having a chemical composition in wt. % as shown in Table 2-1 were cast into ingots on a laboratory scale. The ingots were pre-heated at a temperature of 410° C. for 1 hour followed by a temperature of 510° C. for 15 hours. The ingots were hot rolled from 80 mm to 8 mm and subsequently cold rolled with an interannealing step and a final cold reduction of 40% to a final thickness of 2 mm. The final plate was stretched 1.5% and subsequently annealed at a temperature of 460° C. for 30 min.

TABLE 2-1

| Alloy | Mg | Mn | Zn | Zr | Cr | Ti |
|---|---|---|---|---|---|---|
| A | 5.3 | 0.58 | 0.61 | 0.10 | <0.01 | <0.01 |
| B* | 5.4 | 0.60 | 0.61 | 0.10 | 0.11 | 0.04 |
| C* | 5.3 | 0.59 | 0.61 | 0.10 | <0.01 | 0.10 |
| D* | 5.3 | 0.61 | 0.62 | 0.10 | 0.11 | 0.11 |
| E* | 5.3 | 0.57 | 0.61 | <0.01 | 0.10 | 0.10 |
| F | 5.3 | 0.60 | 0.60 | <0.01 | 0.10 | <0.01 |

*according to the invention

Note:

All alloys contained 0.06 wt. % Fe and 0.04 wt. % Si, balance aluminium and impurities.

The results of mechanical testing of the alloys are shown in Table 2-2.

TABLE 2-2

| Mechanical properties | | | |
|---|---|---|---|
| Alloy | Rp(TYS) MPa | Rm(UTS) MPa | Elongation at fracture A % |
| A | 165 | 316 | 24 |
| B* | 169 | 329 | 23 |
| C* | 168 | 326 | 22 |

TABLE 2-2-continued

| Mechanical properties | | | |
|---|---|---|---|
| Alloy | Rp(TYS) MPa | Rm(UTS) MPa | Elongation at fracture A % |
| D* | 187 | 340 | 22 |
| E* | 183 | 331 | 21 |
| F | 157 | 322 | 24 |

*according to the invention. All samples were taken in the L direction.

Note:

The mechanical properties were established in accordance with ASTM EM8.

Note:

Rp, TYS stands for (tensile) yield strength; Rm, UTS stands for ultimate tensile strength; A stands for elongation at fracture Table 2-2 shows that the yield strength of reference alloy A which contains only an addition of 0.1 wt. % Zr is about 5% stronger than reference alloy F which contains only an addition of 0.1 wt. % Cr. When the performance of alloys A and F are compared to alloy B, which contains additions of 0.1 wt. % Cr and 0.1 wt. % Zr and a minor level of Ti, a small advantage in yield strength is obtained. Furthermore for alloy C which contains only Zr and Ti and no Cr, a small increase in yield strength is observed. However, when Cr is combined with Ti, as presented by alloy E, the strength of the alloy is increased by 11-13% when compared to reference alloy A, and 17-19% when compared to reference alloy F. For the combination where all three elements are added to the alloy (alloy D), a slightly higher strength level to alloy E is observed.

The alloys of Table 2-1 were also submitted to a corrosion test after sensitizing. The results are shown in Table 2-3.

TABLE 2-3

| Corrosion properties | |
|---|---|
| Alloy | Base metal, sensitized 120° C./7 days |
| A | PB-A |
| B* | N, PB-A |
| C* | PB-A |
| D* | N, PB-A |
| E* | N, PB-A |
| F | N, PB-A |

*according to the invention

Corrosion was measured using the standard ASTM G66 test, also known as the ASSET test.

The ratings N and PB-A respectively represent no pitting and slight pitting.

The choice of alloying addition elements also influences the corrosion behavior of the alloy, as shown in Table 2-3. For the alloys which do not contain an addition of Cr (Alloys A and C) some pitting was observed after the corrosion test was performed. However for the Cr containing alloys (Alloys B, D, E, and F) no appreciable attack was observed.

Example 3

This example relates to aluminium alloys of the AA 5xxx series having a chemical composition in wt. % as shown in Table 3-1. Alloys A to F are similar to alloys A to F used in Example 2 but were processed differently. In Table 3-1 also the Sc content is given. The alloys of Table 3-1 are cast into ingots on a laboratory scale. The ingots were pre-heated at a temperature of 450° C. for 1 hour and hot rolled at the pre-heat temperature from a thickness of 80 mm to a thickness of 8 mm. Subsequently the plates were cold rolled with an interannealing step and given a final cold reduction of 40% to a final thickness of 2 mm. The plates were then stretched 1.5% and annealed at a temperature of 325° C. for 2 hours.

TABLE 3-1

| Alloy | Mg | Mn | Zn | Zr | Cr | Ti | Sc |
|---|---|---|---|---|---|---|---|
| A | 5.3 | 0.58 | 0.61 | 0.10 | <0.01 | <0.01 | <0.005 |
| B* | 5.4 | 0.60 | 0.61 | 0.10 | 0.11 | 0.04 | <0.005 |
| C* | 5.3 | 0.59 | 0.61 | 0.10 | <0.01 | 0.10 | <0.005 |
| D* | 5.3 | 0.61 | 0.62 | 0.10 | 0.11 | 0.11 | <0.005 |
| E* | 5.3 | 0.57 | 0.61 | <0.01 | 0.10 | 0.10 | <0.005 |
| F | 5.3 | 0.60 | 0.60 | <0.01 | 0.10 | <0.01 | <0.005 |
| G* | 5.2 | 0.91 | 0.60 | 0.10 | 0.10 | 0.11 | 0.15 |

*according to the invention

Note:

All alloys contained 0.06 wt. % Fe and 0.04 wt. % Si, balance aluminium and impurities.

TABLE 3-2

| Mechanical properties | | | |
|---|---|---|---|
| Alloy | Rp(TYS) MPa | Rm(UTS) MPa | Elongation at fracture A % |
| A | 175 | 318 | 25 |
| B* | 220 | 344 | 22 |
| C* | 195 | 335 | 21 |
| D* | 275 | 373 | 16 |
| E* | 249 | 362 | 20 |
| F | 200 | 323 | 22 |
| G* | 390 | 461 | 9 |

*according to the invention. All samples were taken in the L direction.

Note:

The mechanical properties were established in accordance with ASTM EM8.

Note:

Rp, TYS stands for (tensile) yield strength; Rm, UTS stands for ultimate tensile strength; A stands for elongation at fracture Table 3-2 shows the available mechanical properties of Alloys A to G. Alloy A and alloy F serve as reference alloys in this example. Table 3-2 shows that the yield strength of alloy F with 0.10 wt. % Cr addition is about 14% better than alloy A which has 0.10 wt. % Zr addition. This might appear to be in contradiction with Example 2 which showed that alloy A had a higher yield strength than Alloy F. It is believed that the reason for this difference in behavior can be related to the preheat temperature used prior to hot rolling, for during the preheat, dispersoids are formed which can affect the mechanical properties of the final product.

When a high preheat temperature is used, as in Example 2, the alloy containing only 0.1 wt. % Zr (alloy A) performs slightly better than the alloy containing only 0.1 wt. % Cr (alloy F). However, when a lower preheat temperature is used, the Cr containing alloy is more effective resulting in an improvement when compared to an alloy containing just Zr (alloy A). The properties in Table 3-2 also demonstrate that when Cr is combined with either Ti (alloy E), Zr (alloy B) or both Zr and Ti (alloy D), a considerable strength improvement is observed compared to the reference alloys A and F. The increase in strength of alloys D and E compared to the reference alloys A and F was also seen in Example 2, although the values reached in Example 3 were much higher. This effect is due to the lower preheat temperature used prior to hot rolling.

The highest strength level was achieved with Alloy G which contained the four main dispersoid forming elements (Mn, Cr, Ti and Zr) together with an addition of Sc. A yield strength of 390 MPa was achieved which is superior to any of the alloys mentioned in both Example 2 and 3.

Having now fully described the invention, it will be apparent to one of ordinary skill in the art that many changes and modifications can be made without departing from the spirit and scope of the invention as herein described.

The invention claimed is:

1. An aluminum alloy product having high strength, excellent corrosion resistance and weldability, consisting of the following composition in wt. %:

Mg 3.5 to 6.0
Mn 0.4 to 1.2
Fe 0.06 to <0.5
Si <0.5
Cu <0.05
Zr 0.05 to 0.25
Cr 0.03 to 0.3
Ti 0.05 to 0.2
Sc 0.1 to 0.3
Ag <0.4, and impurities or incidental elements each <0.05, total <0.15, and the balance being aluminum, wherein both Cr and Ti are present in the aluminum alloy product in equal or about equal quantities, and wherein the product is selected from the group consisting of an aircraft fuselage sheet and an aircraft stringer.

2. An aluminum alloy product according to claim 1, wherein the Ti content is in the range 0.05 to 0.12 wt. %.

3. An aluminum alloy product according to claim 1, wherein the Ti content is in the range 0.05 to 0.1 wt. %.

4. An aluminum alloy product according to claim 1, wherein the Cr content is in the range 0.03 to 0.12 wt. %.

5. An aluminum alloy product according to claim 1, wherein the Cr content is in the range 0.03 to 0.1 wt. %.

6. An aluminum alloy product according to claim 1, wherein Mn is in the range of 0.6 to 1.0 wt. %.

7. An aluminum alloy product according to claim 1, wherein Mn is in the range of 0.65 to 0.9 wt. %.

8. An aluminum alloy product according to claim 1, wherein the combined amount of Cr and Zr is in the range 0.06 to 0.25 wt. %.

9. An aluminum alloy product according to claim 1, wherein the combined amount of Cr and Ti is in the range 0.06 to 0.22 wt. %.

10. An aluminum alloy product according to claim 1, wherein the combination of Zr and Ti is in the range 0.06 to 0.25 wt. %.

11. An aluminum alloy product according to claim 1, wherein the combined amount of Cr and Ti and Zr is in the range 0.25 to 0.36 wt. %;

wherein the Ti content is in the range 0.1 to 0.12 wt. %;

wherein the Cr content is in the range 0.1 to 0.12 wt. %.

12. An aluminum alloy product according to claim 1, wherein Mg is in the range of 3.6 to 5.6 wt. %.

13. An aluminum alloy product according to claim 1, wherein Mg is in the range of 3.8 to 4.3 wt. %.

14. An aluminum alloy product according to claim 1, wherein Mg is in the range of 5.0 to 5.6 wt. %.

15. An aluminum alloy product according to claim 1, wherein the product is the aircraft stringer.

16. An aluminum alloy product according to claim 1, wherein the product has a thickness in the range of 0.6 to 12.5 mm at its thickest cross section point.

17. An aluminum alloy product according to claim 1, wherein the product is an extruded product or a rolled product.

18. An aluminum alloy product according to claim 1, wherein the product has a thickness in the range of 0.6 to 80 mm.

19. An aluminum alloy product according to claim 1, wherein the product is the aircraft fuselage sheet.

20. An aluminum alloy product according to claim 1, wherein Fe is in the range of at most 0.14 to <0.5 wt. %.

21. An aluminum alloy product according to claim 1, wherein Si is in the range of at most 0.12 wt. %.

22. An aluminum alloy product according to claim 1, wherein Zr is in the range of 0.08 to 0.16 wt. %.

23. The aluminum alloy product of claim 1, consisting of the following composition in wt. %:

Mg 3.5 to 4.0
Mn 0.4 to 0.9
Fe 0.06 to 0.14
Si <0.5
Zr 0.08 to 0.11
Cr 0.05 to 0.1
Ti 0.05 to 0.12
Sc 0.1 to 0.15
and impurities or incidental elements each <0.05, total <0.15, and the balance being aluminum.

24. The aluminum alloy product of claim 1, consisting of the following composition in wt. %:

Mg 3.8 to 4.0
Mn 0.65 to 0.9
Fe 0.06 to 0.14
Si <0.12
Zr 0.08 to 0.11
Cr 0.05 to 0.1
Ti 0.05 to 0.1
Sc 0.1 to 0.15
and impurities or incidental elements each <0.05, total <0.15, and the balance being aluminum.

25. The aluminum alloy product of claim 1, wherein the alloy product comprises welded plates of the alloy having a heat affected zone corrosion rating of N according to ASTM G66.

26. The aluminum alloy product of claim 24, wherein the alloy product comprises welded plates of the alloy having a heat affected zone corrosion rating of N according to ASTM G66.

27. The aluminum alloy product of claim 1, consisting of the following composition in wt. %:

Mg 3.87 to 4.0
Mn 0.65 to 0.9
Fe 0.06 to 0.14
Si 0.04 to 0.12
Zr 0.1 to 0.11
Cr 0.05 to 0.1
Ti 0.05 to 0.12
Sc 0.1 to 0.15
and impurities or incidental elements each <0.05, total <0.15, and the balance being aluminum, wherein the alloy has an Rp of 380 to 393 MPa and welded plates of the alloy have a heat affected zone corrosion rating of N according to ASTM G66.

28. The aluminum alloy product of claim 1, consisting of the following composition in wt. %:

Mg 3.5 to 6.0
Mn 0.4 to 1.2
Fe 0.06 to 0.14
Si <0.5
Zr 0.05 to 0.25
Cr 0.03 to 0.3
Ti 0.05 to 0.2
Sc 0.1 to 0.3
Ag <0.4,
optionally one or more of the following dispersoids forming elements selected from the group consisting of erbium, yttrium, hafnium, vanadium, each <0.5 wt. %; and
the balance being aluminum.

29. The aluminum alloy product of claim 1, wherein the quantity of Cr in the aluminum alloy product is within 0.02 wt. % of the quantity of Ti.

30. The aluminum alloy product of claim 27, wherein the quantity of Cr in the aluminum alloy product is within 0.02 wt. % of the quantity of Ti.

* * * * *